US009693409B1

(12) United States Patent
Deniken

(10) Patent No.: US 9,693,409 B1
(45) Date of Patent: Jun. 27, 2017

(54) TEXTILE WITH INTEGRATED ILLUMINATION FEATURE

(71) Applicant: Richard Deniken, Cherry Hill, NJ (US)

(72) Inventor: Richard Deniken, Cherry Hill, NJ (US)

( * ) Notice: Subject to any disclaimer, the term of this patent is extended or adjusted under 35 U.S.C. 154(b) by 0 days.

(21) Appl. No.: 15/163,284

(22) Filed: May 24, 2016

(51) Int. Cl.
*H05B 33/08* (2006.01)
*D03D 25/00* (2006.01)

(52) U.S. Cl.
CPC ..... *H05B 33/0842* (2013.01); *D03D 25/00* (2013.01); *H05B 33/0809* (2013.01); *H05B 33/0896* (2013.01)

(58) Field of Classification Search
CPC ..... H05B 33/0815; H05B 33/0818; H05B 33/0884; H05B 33/0809; H05B 33/0848; H05B 33/0896; D03D 15/00; D03D 25/00; D03D 1/00
USPC ..... 315/294, 307, 122, 192, 224, 76
See application file for complete search history.

(56) References Cited

U.S. PATENT DOCUMENTS 5,910,598 A * 6/1999 Shofner ..... D03J 1/008 139/1 C
6,360,615 B1 * 3/2002 Smela ..... A61B 5/1124 73/862.474
D582,634 S 12/2008 Lagassey
7,598,928 B1 10/2009 Buskop
7,824,053 B2 11/2010 Maier, Sr.
8,121,335 B2 2/2012 Sharpe
2004/0037091 A1 * 2/2004 Guy ..... D03D 15/00 362/582
2005/0176323 A1 * 8/2005 Minato ..... D01D 5/253 442/185
2005/0248722 A1 11/2005 Nelis
2009/0033856 A1 * 2/2009 Kiryuschev ..... G06F 3/1446 349/150
2009/0293166 A1 * 12/2009 Shayne ..... G06Q 30/02 2/20
2010/0071205 A1 * 3/2010 Graumann ..... D03D 1/0088 29/825
2010/0265731 A1 * 10/2010 Van Herpen ..... B60Q 1/52 362/543
2010/0313334 A1 12/2010 Moy
2011/0073353 A1 * 3/2011 Lee ..... D03D 1/0088 174/254

(Continued)

FOREIGN PATENT DOCUMENTS

CN 204180959 U 3/2015

*Primary Examiner* — Douglas W Owens
*Assistant Examiner* — Syed M Kaiser
(74) *Attorney, Agent, or Firm* — Kyle A. Fletcher, Esq.

(57) ABSTRACT

The textile with integrated illumination feature is a textile that incorporates electrical components in such a manner that: 1) the textile can be illuminated; and 2) the illumination of the textile can be controlled in a programmable manner. The textile is formed with a plurality of wires that are used to provide circuit connections with a plurality of LEDs that are illuminated using a plurality of control circuits. The plurality of control circuits are controlled using a logic module. The plurality of wires are formed into the textile using a plurality of methods discussed in this disclosure. The plurality of LEDs are then connected into the plurality of wires. The plurality of controls circuits control the voltages on each of the plurality of wires. The logic module is used to control the voltage level generated by the plurality of control circuits.

19 Claims, 6 Drawing Sheets

(56) References Cited

U.S. PATENT DOCUMENTS

| | | | | |
|---|---|---|---|---|
| 2011/0175553 | A1* | 7/2011 | Sampsell | H05B 37/0245 315/312 |
| 2011/0269358 | A1* | 11/2011 | Peng | D03D 1/0088 442/59 |
| 2012/0062571 | A1 | 3/2012 | Malek | |
| 2013/0200791 | A1* | 8/2013 | Van Herpen | F21V 23/026 315/71 |
| 2015/0046375 | A1* | 2/2015 | Mandel | G06N 5/02 706/11 |
| 2015/0190669 | A1* | 7/2015 | Matsuura | A63B 21/02 482/8 |
| 2015/0366504 | A1* | 12/2015 | Connor | A61B 5/6804 600/301 |
| 2015/0370320 | A1* | 12/2015 | Connor | A61B 5/6831 345/173 |
| 2016/0345679 | A1* | 12/2016 | Beers | A43B 23/07 |
| 2016/0358849 | A1* | 12/2016 | Jur | H01L 23/5328 |

* cited by examiner

TEXTILE WITH INTEGRATED ILLUMINATION FEATURE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of battery powered portable lighting devices, more specifically, a textile with optical physical properties.

SUMMARY OF INVENTION

The textile with integrated illumination feature is a textile that is formed incorporating electrical components in such a manner that: 1) the textile can be illuminated; and 2) the illumination of the textile can be controlled in a programmable manner. The textile is formed with a plurality of wires that are used to provide circuit connections with a plurality of LEDs that are illuminated using a plurality of control circuits. The plurality of control circuits are controlled using a logic module. The plurality of wires are formed into the textile using a plurality of methods discussed in this disclosure. The plurality of LEDs are then connected into the plurality of wires. The plurality of controls circuits control the voltages on each of the plurality of wires. The logic module is used to control the voltage level generated by the plurality of control circuits.

These together with additional objects, features and advantages of the textile with integrated illumination feature will be readily apparent to those of ordinary skill in the art upon reading the following detailed description of the presently preferred, but nonetheless illustrative, embodiments when taken in conjunction with the accompanying drawings.

In this respect, before explaining the current embodiments of the textile with integrated illumination feature in detail, it is to be understood that the textile with integrated illumination feature is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the textile with integrated illumination feature.

It is therefore important that the claims be regarded as including such equivalent construction insofar as they do not depart from the spirit and scope of the textile with integrated illumination feature. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
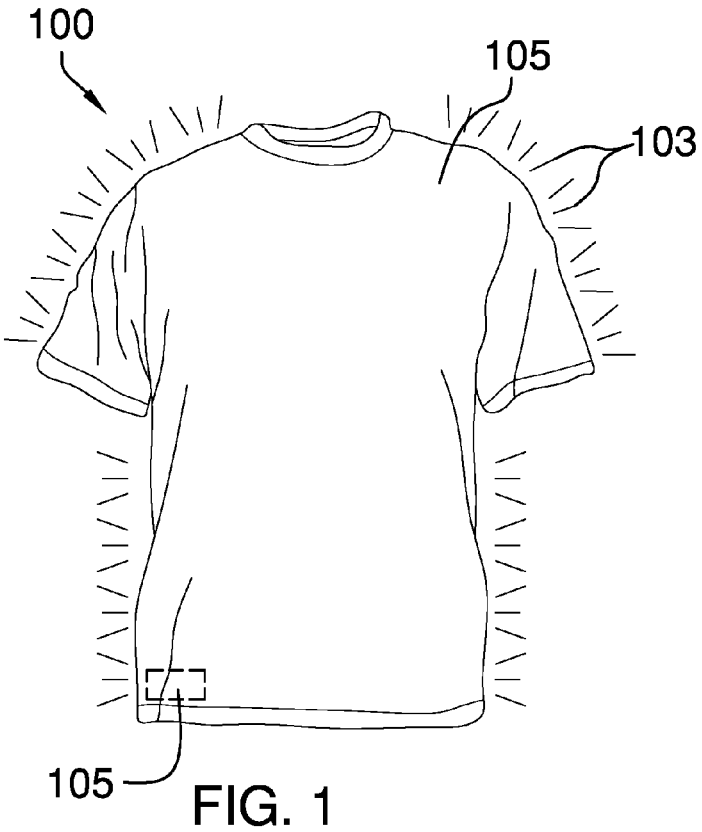
FIG. 1 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 8.

The textile with integrated illumination feature (hereinafter 100) comprises a plurality of yarns 101, a plurality of wires 102, a plurality of LEDs 103, a plurality of control circuits 104, and a logic module 105. The invention 100 is a textile 106 that is formed incorporating electrical components in such a manner that: 1) the textile 106 can be illuminated; and 2) the illumination of the textile 106 can be controlled in a programmable manner. The textile 106 is formed with a plurality of wires 102 that are used to provide circuit connections with a plurality of LEDs 103 that are illuminated using a plurality of control circuits 104. The plurality of control circuits 104 are controlled using a logic module 105. The plurality of wires 102 are formed into the textile 106 using a plurality of methods discussed in this disclosure. The plurality of LEDs 103 are then connected into the plurality of wires 102. The plurality of control circuits 104 control the voltages on each of the plurality of wires 102. The logic module 105 is used to control the voltage level generated by the plurality of control circuits 104.

The plurality of yarns 101 forms the basis of the textile 106 that contain the illumination. Each of the plurality of yarns 101 is a commercially available yarn. Suitable yarns for use with in manufacturing the textile 106 include, but are not limited to, cotton, wool, rayon, nylon, and polyester. Specifically, the plurality of yarns 101 form a textile 106 using a weaving or knitting process. In selected potential embodiments of the disclosure, the plurality of yarns will be incorporated into a composite textile 106. Methods to weave and knit textiles 106 are well known and documented in the textile arts.

The plurality of wires 102 are a collection of metal wires that are incorporated in the textile 106. Two methods to incorporate the plurality of wires 102 into the textile 106 are described in this disclosure. In the first method, as shown most clearly in FIG. 4, each individual wire associated with the plurality of wires 102 is treated as an individual warp yarn and is woven or knitted directly into the textile 106. In this first method, each individual wire selected from the plurality of wires 102 is insulated and isolated from the individual wires remaining in the plurality of wires 102 by the individual yarns selected from the plurality of yarns 101 that are placed between the individual wires within the body of the textile 106. The insertion of the plurality of wires 102 in the manner described in the first method is suitable for use with the basic weaving and knitting patterns including 1×1 patterns, 2×2 patterns, tubular pattern and satin patterns. It is noted for informational purposes that: 1) care needs to be taken in both the manufacture and use when incorporating the concepts of this disclosure within tubular patterns to prevent inadvertent electrical shorts; and, 2) the first method is particularly suited for the use with jacquard based weaving and knitting equipment. As discussed in detail elsewhere in this disclosure, during use each individual wire selected from the plurality of wires 102 will have a specific voltage applied to it. Each individual LED selected from the plurality of LEDs 103 is driven by the voltage difference between a first wire selected from the plurality of wires 102 and a second wire selected from the plurality of wires 102.

Figure 2:
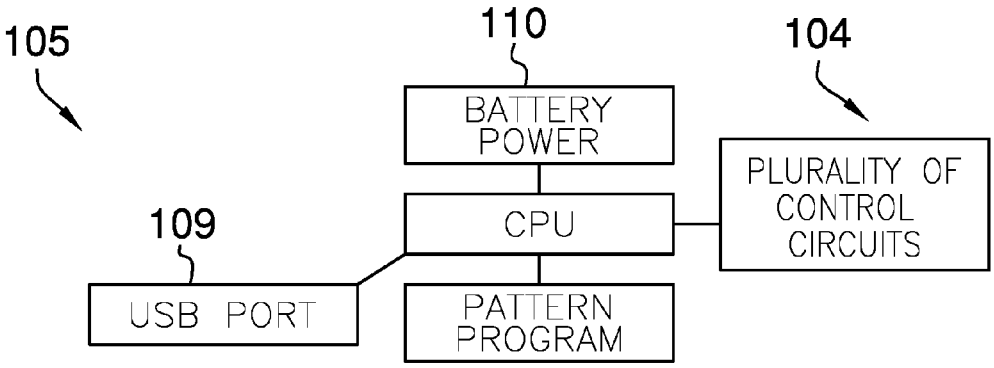
FIG. 2 is a block diagram of an embodiment of the disclosure.
Figure 3:
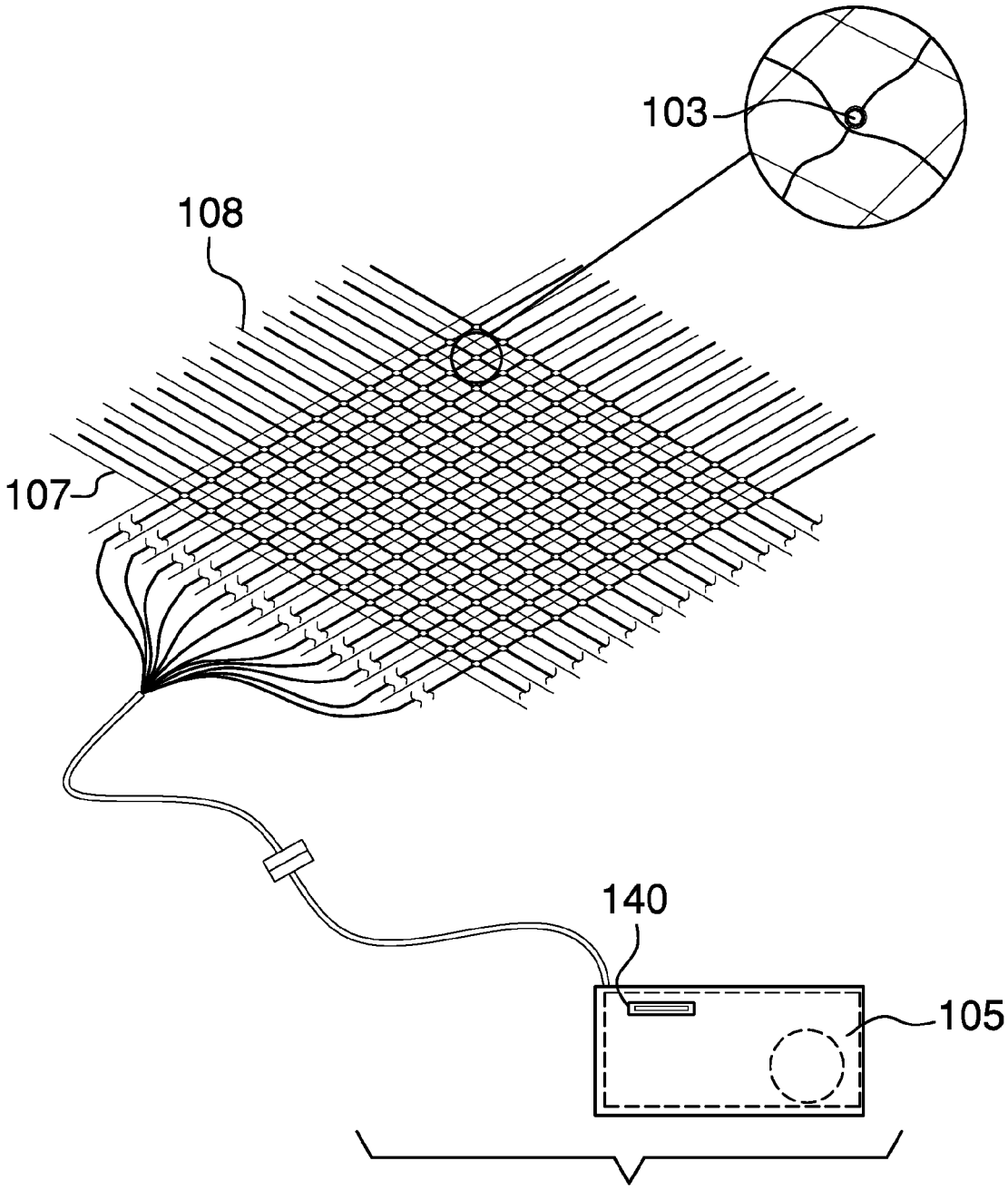
FIG. 3 is a detail view of an embodiment of the disclosure.
Figure 4:
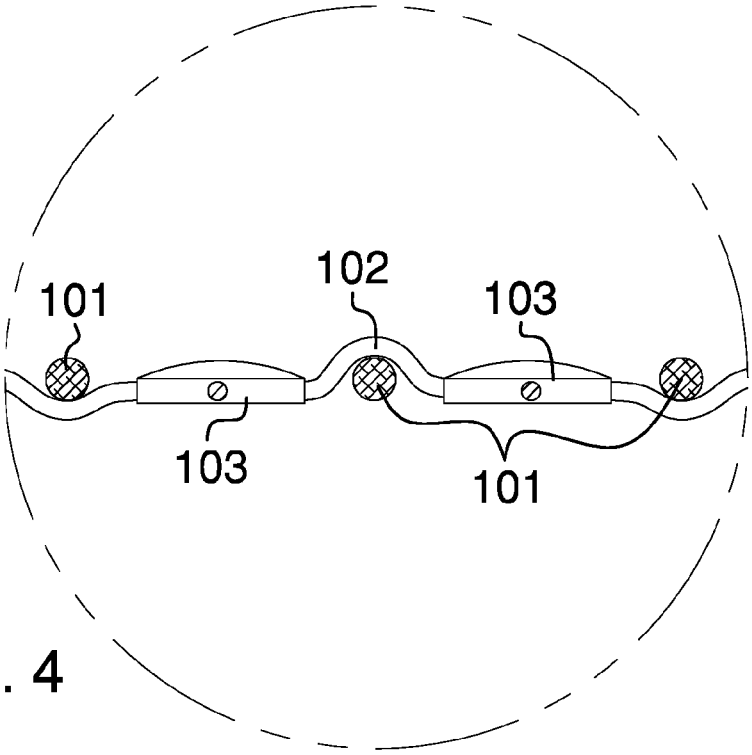
FIG. 4 is a detail view of an embodiment of the disclosure.
Figure 5:
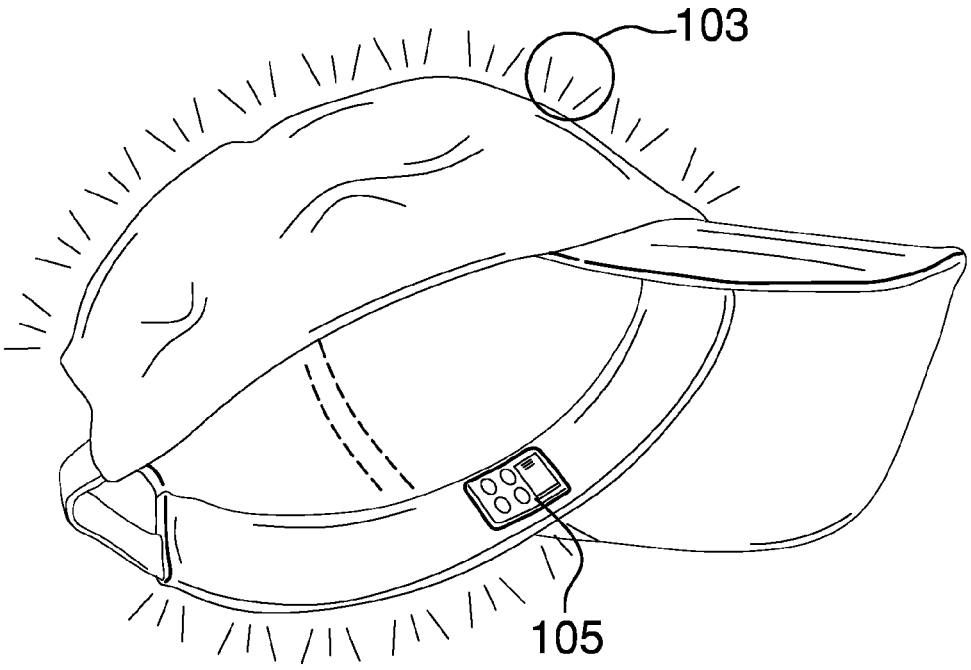
FIG. 5 is a perspective view of an alternate embodiment of the disclosure.

In the second method, as shown most clearly in FIG. 2, the plurality of wires 102 are subdivided into a plurality of sub-plurality of wires. Each sub-plurality of wires is formed into a wire mesh 107. The collection of sub-plurality of wires forms a plurality of wire meshes 108. The wire mesh 107 is a net like structure wherein each wire selected from the wire mesh 107 is electrically connected to the wires remaining in the wire mesh 107 such that the entire wire mesh 107 will be at a single voltage level that equals a voltage that is applied to one or more wires selected form the wire mesh 107. Each individual LED selected from the plurality of LEDs 103 is driven by the voltage difference between a first wire mesh 107 selected from the plurality of wire meshes 108 and a second wire mesh 107 selected from the plurality of the wire meshes 108. The textile 106 is formed as a multi-layer composite textile wherein each of the plurality of wire meshes 108 are interspersed between other textile or sheeting layers. Each wire mesh 107 selected from the plurality of wire meshes 108 are insulated and isolated from the wire meshes 107 remaining in the plurality of wire meshes 108 by the textile or sheeting layers described above. Methods to form composite textiles incorporating not traditional materials are well known and documented in the textile arts.

In the first method and the second method, a fine wire gauge is suggested. Specifically, a wire diameter of 0.254 mm (30 gauge) or finer is recommended. A wire diameter of 0.102 mm (38 gauge) is preferred.

Each of the plurality of LEDs 103 is a commercially available light emitting diode. The light emitting diode is a two terminal semiconductor device that is used to generate light. Each LED is further defined with an anode and a cathode. Suitable diodes for use in this disclosure include, but are not limited to, standard LEDs and organic LEDs. Those skilled in the art will recognize that theoretical devices known as micro LEDs are also be suitable for use within this disclosure. When the invention 100 is manufactured using the first described method, the anode of each LED selected from the plurality of LEDs 103 is electrically connected to a first wire selected from the plurality of wires 102. Similarly, the cathode of each LED selected from the plurality of LEDs 103 is electrically connected to a second wire selected from remaining wires in the plurality of wires 102.

When the invention 100 is manufactured using the second described method, the anode of each LED selected from the plurality of LEDs 103 is electrically connected to a first wire mesh 107 selected from the plurality of wire meshes 108. Similarly, the cathode of each LED selected from the plurality of LEDs 103 is electrically connected to a second wire mesh 107 selected from the plurality of wire meshes 108 in an electrically isolated manner. By electrically isolated manner is meant that neither the anode nor the cathode are in uninsulated physical contact with any wire meshes 107 other than the first selected wire mesh 107 and the second selected wire mesh 107.

The operation of the invention 100 as well as the details of the connection of the plurality of LEDs 103 to the plurality of wires 102, and by implication the plurality of wire meshes 108, is now discussed. A simplified schematic of the wiring of the plurality of LEDs 103 is shown on FIG. 6. In the simplified schematic, the plurality of LEDs 103 comprises a first LED 121, a second LED 122, a third LED 123, a fourth LED 124, a fifth LED 125, a sixth LED 126, a seventh LED 127, an eighth LED 128, a ninth LED 129, a tenth LED 130, an eleventh LED 131, and a twelfth LED 132. The plurality of wires 102, as described in the first method, comprises a first line 111, a second line 112, a third line 113, and a fourth line 114 wherein each line represents a wire selected from the plurality of wires 102. The plurality of wire meshes 108, as described in the second method, also comprise the same first line 111, the same second line 112, the same third line 113, and the same fourth line 114 wherein each line represents a wire mesh 107 selected from the plurality of wire meshes 108. Those skilled in the electrical arts will recognize the interchangeable nature of the plurality of wires 102 and the plurality of wire meshes 108 after a review of the provided description.

Figure 6:
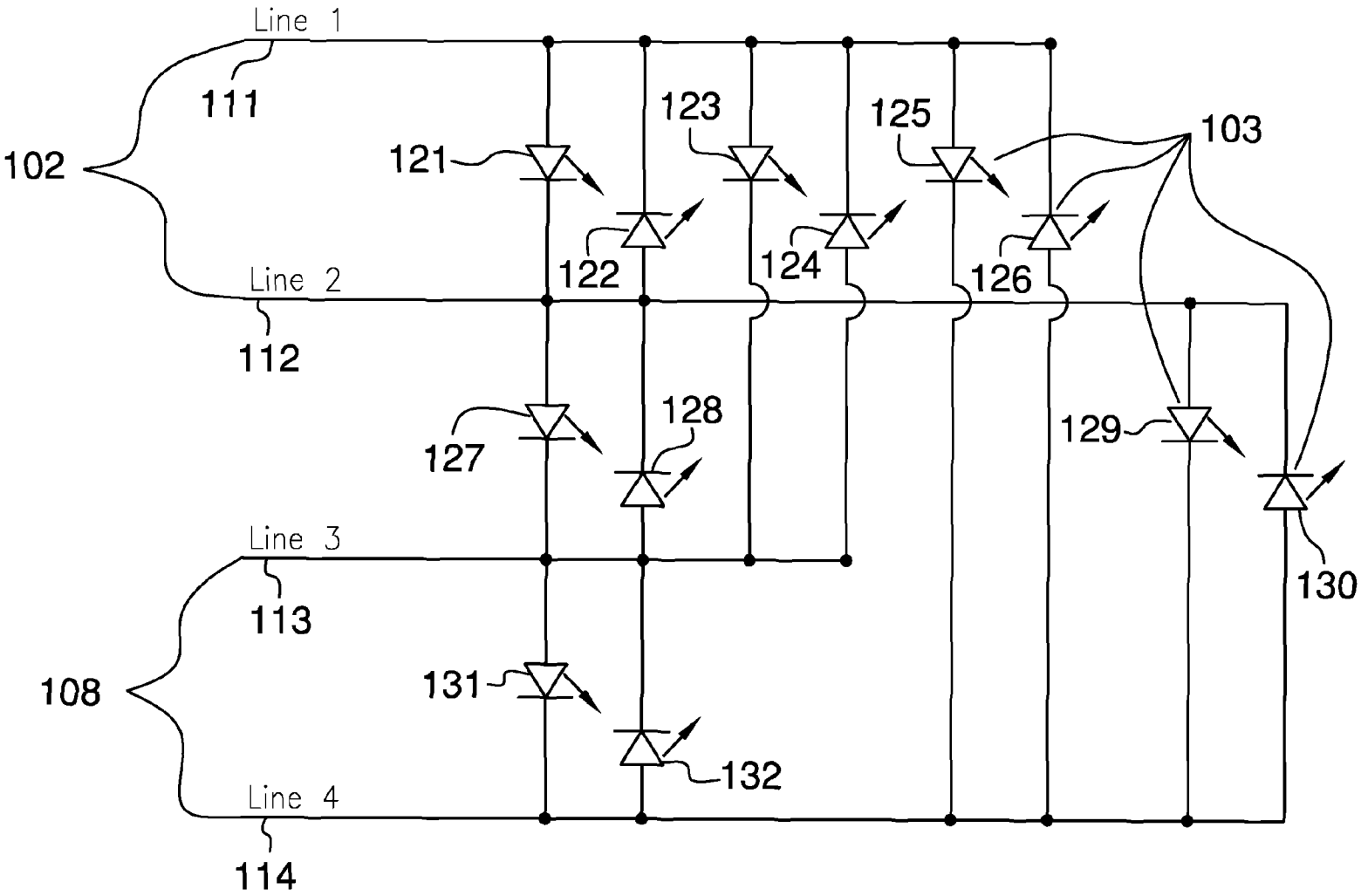
FIG. 6 is a schematic view of an embodiment of the disclosure.

As shown on FIG. 6, the anode of the first LED 121 is attached to the first line 111 and the cathode of the first LED 121 is attached to the second line 112. The anode of the second LED 122 is attached to the second line 112 and the cathode of the second LED 122 is attached to the first line 111. The anode of the third LED 123 is attached to the first line 111 and the cathode of the third LED 123 is attached to the third line 113. The anode of the fourth LED 124 is attached to the third line 113 and the cathode of the fourth LED 124 is attached to the first line 111. The anode of the fifth LED 125 is attached to the first line 111 and the cathode of the fifth LED 125 is attached to the fourth line 114. The anode of the sixth LED 126 is attached to the fourth line 114 and the cathode of the sixth LED 126 is attached to the first line 111. The anode of the seventh LED 127 is attached to the second line 112 and the cathode of the seventh LED 127 is attached to the third line 113. The anode of the eighth LED 128 is attached to the third line 113 and the cathode of the eighth LED 128 is attached to the second line 112. The anode of the ninth LED 129 is attached to the second line 112 and the cathode of the ninth LED 129 is attached to the fourth line 114. The anode of the tenth LED 130 is attached to the fourth line 114 and the cathode of the tenth LED 130 is attached to the second line 112. The anode of the eleventh LED 131 is attached to the third line 113 and the cathode of the eleventh LED 131 is attached to the fourth line 114. The anode of the twelfth LED 132 is attached to the fourth line 114 and the cathode of the twelfth LED 132 is attached to the third line 113.

In this configuration, each line selected from the group consisting of the first line 111, the second line 112, the third line 113, and the fourth line 114 is attached with to the remaining lines with two LEDs. The theory of operation of this arrangement is that when a voltage difference exists between any two lines selected from the group consisting of the first line 111, the second line 112, the third line 113, and the fourth line 114 at least one of the two LEDs connecting the two selected lines will illuminate. Therefore by managing the voltage differential between two lines selected from the group consisting of the first line 111, the second line 112, the third line 113, and the fourth line 114 the invention 100 can exhibit control over which of the plurality of LEDs 103 are illuminated.

It is now possible to discuss what is meant by a "simplified" schematic. It is anticipated by the inventor that in potential embodiments of the invention 100, that, especially given the light weight of an LED (estimate: 1 kg per 3000 LEDs), the count of LEDs in the plurality of LEDs 103 can be in the thousands in any given use of the textile 106. Similarly it is anticipated that the count of the plurality of wires 102 can range from 10 wires to more than 250 individual wires and that the count of wire meshes 107 in the plurality of wire meshes 108 can range from a count of 4 to 20 individual wire meshes 107. A description of the assembly and the operation of the invention 100 at this level of detail is not necessary to understand the intent of the disclosure. Therefore, this description will hereinafter assume the use of the first LED 121, the second LED 122, the third LED 123, the fourth LED 124, the fifth LED 125, the sixth LED 126, the seventh LED 127, an eighth LED 128, the ninth LED 129, the tenth LED 130, an eleventh LED 131, and the twelfth LED 132 as well as the use of the first line 111, the second line 112, the third line 113, and the fourth line 114. This is done for the purposes of simplicity and for clarity of the exposition of the disclosure is not intended to limit the scope of the appended claims. Those skilled in the art will recognize that the disclosure can be readily modified to accommodate an expansion in the number of LEDs and in the number of electrically conductive lines with a minimum of modification and experimentation. Specifically, those skilled in the art will recognize that the pair of diodes connected to any two lines can be readily expanded to accommodate multiple pairs of diodes without undue experimentation. Once it is disclosed that each line has a dedicated individual control circuit 140 selected from the plurality of control circuits 104 those skilled in the electrical art will also recognize that number of lines described can be readily expanded without undue experimentation.

The voltage level of each line selected from the group consisting of the first line 111, the second line 112, the third line 113, and the fourth line 114 is determined by the logic module 105. The logic module 105 is a programmable device that generates control signals that are used by the plurality of control circuits 104. Specifically, the logic module 105 generates a primary line signal 161, and in some embodiments, a secondary line signal 162. The logic module 105 generates a dedicated primary line signal 161 for each individual control circuit 140 contained in the plurality of control circuits 104. When used, the logic module 105 generates a separate dedicated secondary line signal 162 for each individual control circuit 140 contained in the plurality of control circuits 104. When the primary line signal 161 is generated, the primary line signal 161 triggers the individual control circuit 140 associated with the primary line signal 161 to generate and apply a first voltage to the line associated with the individual control circuit 140. When the secondary line signal 162 is generated simultaneously with the primary line signal 161, the secondary line signal 162 triggers the individual control circuit 140 associated with the secondary line signal 162 to generate and apply a second voltage to the line associated with the individual control circuit 140. The second voltage is double the voltage of the first voltage.

The logic module 105 further comprises a battery 110. The battery 110 is a commercially available rechargeable battery. The battery 110 is used to power the logic module 105, the plurality of control circuits 104, and the plurality of LEDs 103. The chemical energy stored within the battery 110 is renewed and restored through use of a charging device. The charging device is an electrical circuit that reverses the polarity of the battery 110 and provides the energy necessary to reverse the chemical processes that the battery 110 initially used to generate the electrical energy. This reversal of the chemical process creates a chemical potential energy that will later be used to generate electricity. In all potential embodiments of the disclosure, the battery 110 is recharged through the use of a USB port 109.

Each individual control circuit 140 selected from the plurality of control circuits 104 is associated with a line selected from the group consisting of the first line 111, the second line 112, the third line 113, and the fourth line 114. In any given instantiation of the invention, each individual control circuit 140 selected from the plurality of control circuits 104 is identical to the individual control circuits 140 remaining in the plurality of control circuits 104. The each individual control circuit 140 is a switching circuit that: 1) applies the first voltage or second voltage to the line associated with the individual control circuit 140; or, 2) connects the line associated with the individual control circuit 140 to a ground that completes a circuit created by another line selected from the group consisting of the first line 111, the second line 112, the third line 113, and the fourth line 114 and the LED connecting the line associated with the individual control circuit 140 and the other line selected from the group consisting of the first line 111, the second line 112, the third line 113, and the fourth line 114. The specific LED used in the circuit is the LED that has its anode connected to the other line selected from the group consisting of the first line 111, the second line 112, the third line 113, and the fourth line 114 and its cathode selected to the line associated with the individual control circuit 140.

This disclosure is now in a position to complete the theory of operation of the invention 100. For any first selected line selected from the group consisting of the first line 111, the second line 112, the third line 113, and the fourth line 114 and any second selected line the group consisting of the first line 111, the second line 112, the third line 113, and the fourth line 114 three logical conditions can occur: 1) the voltage applied to the first selected line is greater than the voltage applied to the second selected line; 2) the voltage applied to the second selected line is greater than the voltage applied to the first selected line; or 3) the voltage applied to the first selected line equals the voltage applied to the second selected line. In the case where the voltage applied to the first selected line is greater than the voltage applied to the second selected voltage, the LED that has its anode connected to the first selected line and its cathode connected to the second selected line will illuminate. In the case where the voltage applied to the second selected line is greater than the voltage applied to the first selected voltage, the LED that has its anode connected to the second selected line and its cathode connected to the first selected line will illuminate. In the case where the voltage applied to the first selected line equals the voltage applied to the second selected voltage, neither LED will illuminate.

By using the logic module 105 to control the voltages of each line selected from the group consisting of the first line 111, the second line 112, the third line 113, and the fourth line 114 it is possible to provide programmed control of the display and the illumination of the plurality of LEDs 103.

This disclosure now addresses the individual control circuits 140 contained within the plurality of control circuits 104. Two specific control circuits are disclosed as potential individual control circuits 140: a binary control circuit 141 and a trinary control circuit 142. The binary control circuit 141 is designed to trigger off the primary line signal 161. The design of the trinary control circuit 142 incorporates the secondary line signal 162. The advantage of the trinary control circuit 142 over the binary control circuit 141 is flexibility in the display and the illumination of the plurality of LEDs 103.

Figure 7:
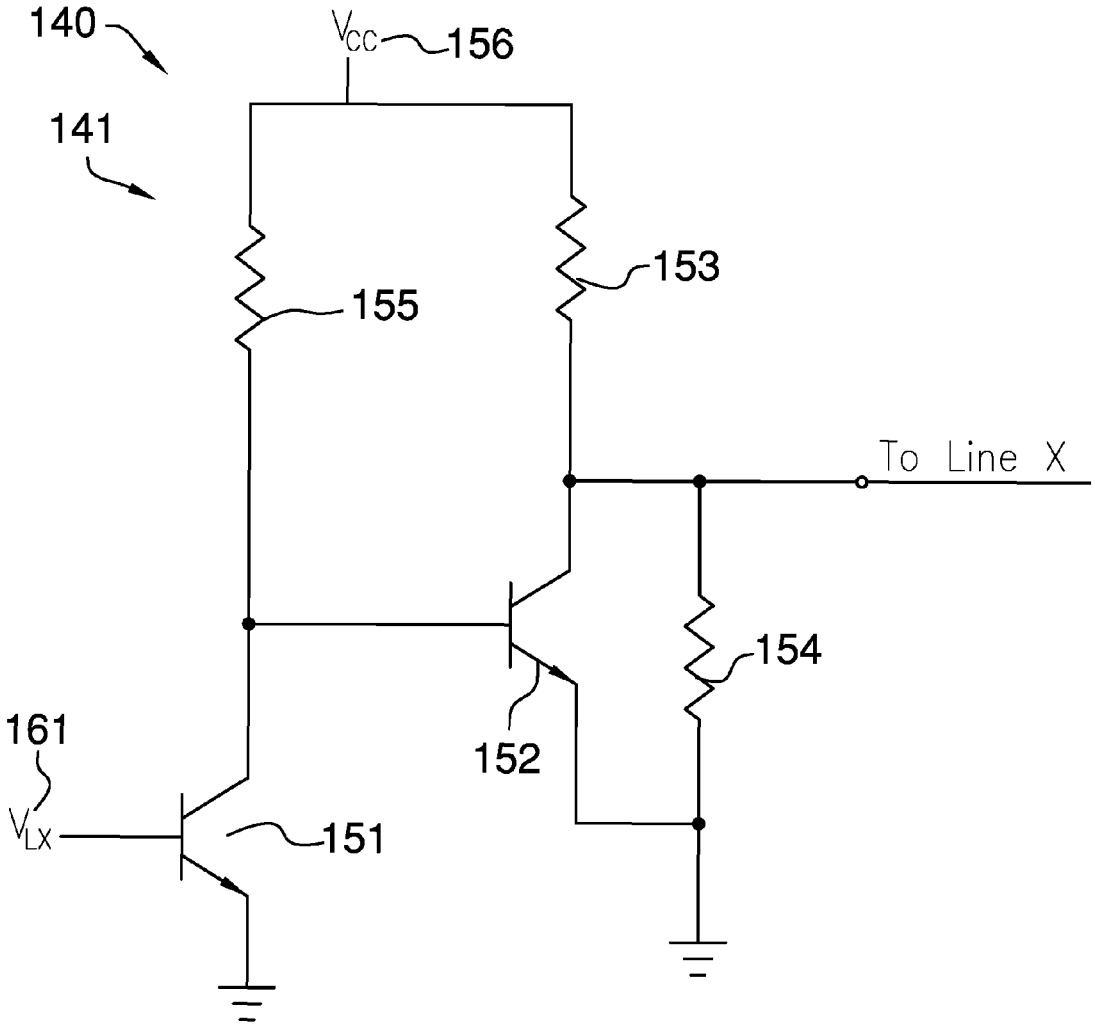
FIG. 7 is a schematic view of an embodiment of the disclosure.
Figure 8:
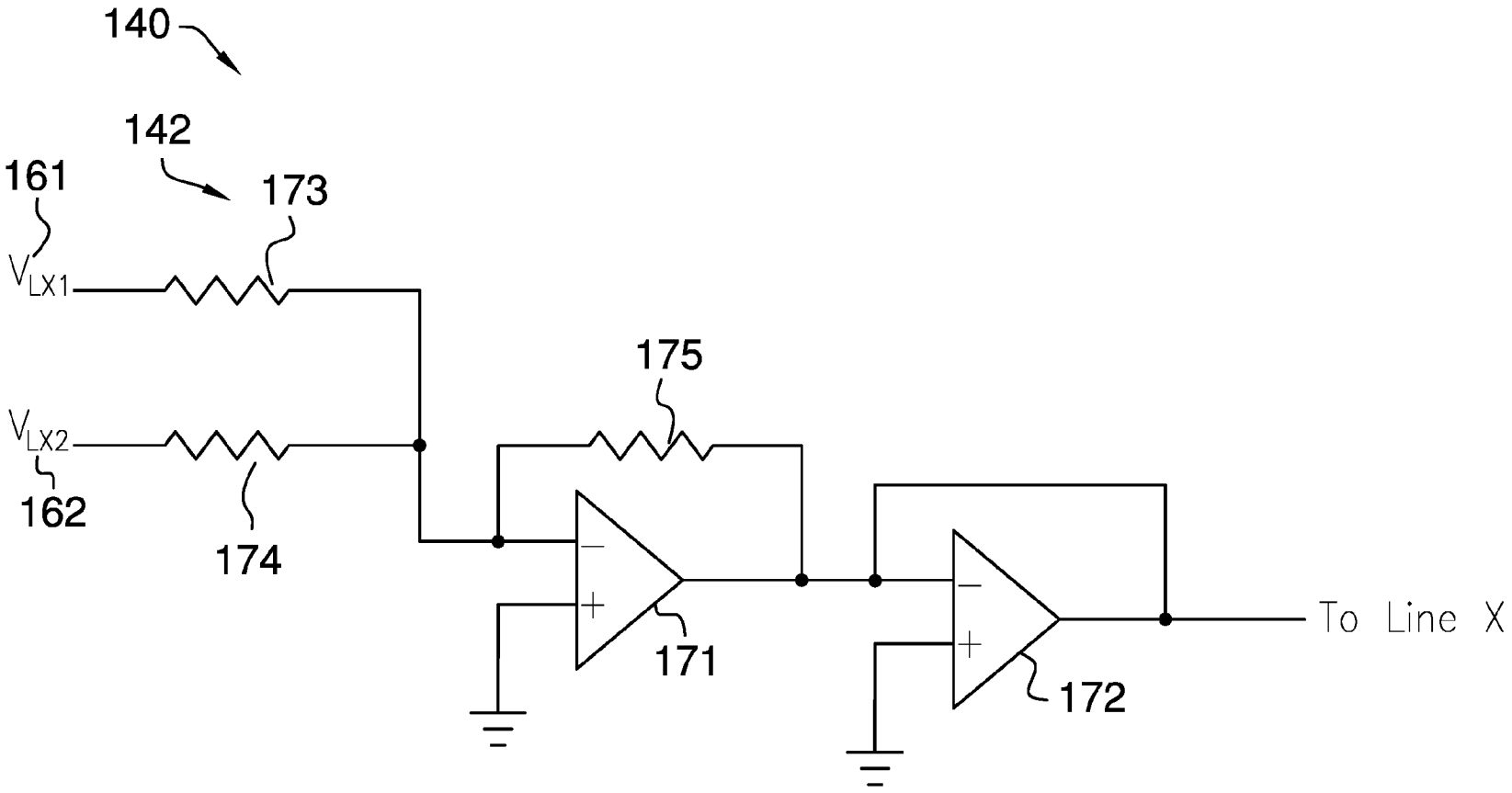
FIG. 8 is a schematic view of an embodiment of the disclosure.

As shown in FIG. 7, the binary control circuit 141 comprises a first transistor 151, a second transistor 152, a first resistor 153, a second resistor 154, and a third resistor 155. The binary control circuit 141 also requires for operation a supply voltage referred to as the Vcc 156 which is provided by the logic module 105. As shown most clearly in FIG. 1, the Vcc 156 is directly connected to first resistor 153 and the third resistor 155. The remaining lead of the third resistor 155 is connected to the collector of the first transistor 151 and to the base of the second transistor 152. The primary line signal 161 is connected to the base of the first transistor 151. The emitter of the first transistor 151 is attached to the ground. The remaining lead of the first resistor 153 is connected to the collector of the second transistor 152, the second resistor 154 and the line that is associated with the binary control circuit 141. The emitter of the second transistor 152 and the remaining lead of the second resistor 154 are connected to a ground for the circuit.

The theory of operation of the binary control circuit 141 is described in this paragraph. The collector of the second transistor 152 is the connection in the circuit that will drive the voltage applied to the line that is associated with the binary control circuit 141. The third resistor 155 is a limit resistor that limits the flow of current through the circuit in order to protect the components within the circuit. The first resistor 153 and the second resistor 154 are used to limit and direct the flow of current through the circuit. The first transistor 151 and the second transistor 152 operate as switches within the binary control circuit 141. When the primary line signal 161 is active (positive voltage), the first transistor 151 will act like a closed switch which directly ground connects the base of the second transistor 152 to ground. By grounding (zero voltage) the base of the second transistor 152, the second transistor 152 will act like an open switch which generates a voltage across the second resistor 154 from the collector of the second transistor 152 to the ground. When the primary line signal 161 is at zero voltage, the first transistor 151 opens which applies a positive voltage to the base of the second transistor 152. The second transistor 152 acts as a closed switch which shorts out the second resistor 154 thus grounding out the voltage on the line that is associated with the binary control circuit 141.

The trinary control circuit 142 comprises a first operational amplifier 171, a second operational amplifier 172, a fourth resistor 173, a fifth resistor 174, and a sixth resistor 175. The fourth resistor 173, the fifth resistor 174 and the sixth resistor 175 are assumed to have the same value, however, those skilled in the electrical arts will recognize that the resistance values can be readily adjusted to meet supplemental design goals with a minimum of experimentation. The fourth resistor 173, the fifth resistor 174, the sixth resistor 175, and the first operational amplifier 171 are arranged in a standard voltage adder circuit. In this scenario, when the voltages of the primary line signal 161 and the secondary line signal 162 are added together to create an output voltage equal to the negative of the sum of the individual voltage level of the primary line signal 161 and the individual voltage level of the secondary line signal 162. If the voltage level of the secondary line signal 162 is the same as the voltage level of the primary line signal 161, the activation of the secondary line signal 162 will essentially double the output voltage of the trinary control circuit 142. The second operational amplifier 172 is configured as an inverter which inverts the output of the first operational amplifier 171 from a negative voltage to a positive voltage. Voltage adder circuits are well known and documented in the electrical arts. Inverter circuits are well known and documented in the electrical arts.

As presented in this disclosure, the binary control circuit 141 will light the plurality of LEDs 103 in 15 distinct patterns. As presented in this disclosure, the trinary control circuit 142 will light the plurality of LEDs 103 in 51 distinct patterns. This flexibility increases as the line count increases. The flexibility of the invention 100 further increases through the creative placement of each of the plurality of LEDs within the textile 106 and as the LED count of the plurality of LEDs 103 increases. Included within this disclosure is a table titled Binary Control that provides the truth table associated with the plurality of LEDs 103 for the binary control circuit 141 described in this disclosure. The Binary Control Table is built assuming hypothetical voltage levels of 0 and 1. Included within this disclosure is a table titled Trinary Control that provides the truth table associated with the plurality of LEDs 103 for the binary control circuit 141 described in this disclosure. Duplicative illumination patterns are excluded from this table. The Trinary Control Table is built assuming hypothetical voltage levels of 0, 1, and 2.

The following definitions were used in this disclosure:

Anodes and Cathodes: As used in this disclosure, an anode and a cathode are the connecting terminals of an electrical circuit element or device. Technically, the cathode is the terminal through which the physical electrons flow into the device. The anode is the terminal through which the physical electrons flow out of the device. As a practical matter the anode refers to: 1) the positive terminal of a power consuming electrical circuit element; 2) the negative terminal of a discharging battery or an electrical power source; and, 3) the positive terminal of a charging battery. As a further practical matter the cathode refers to: 1) the negative terminal of a power consuming electrical circuit element; 2) the positive terminal of a discharging battery or an electrical power source; and, 3) the negative terminal of a charging battery.

Battery: As used in this disclosure, a battery is a container consisting of one or more cells, in which chemical energy is converted into electricity and used as a source of power.

Composite Textile: As used in this disclosure, a composite textile is a multilayer fabric made of two or more joined layers of textile or sheeting materials.

Correspond: As used in this disclosure, the term correspond is used as a comparison between two or more objects wherein one or more properties shared by the two or more objects match, agree, or align.

Diode: As used in this disclosure, a diode is a two terminal semiconductor device that allows current flow in only one direction. The two terminals are called the anode and the cathode.

LED: As used in this disclosure, an LED is an acronym for a light emitting diode. A light emitting diode is a diode that is also a light source. Because of close operational correspondence of the function of the cathode and anode of an organic LEDs and the cathode and anode of a semiconductor LED, organic LEDs are included in this definition.

Logic Module: As used in this disclosure, a logic module is an electrical device that is programmable and that accepts digital and analog inputs, processes the digital and analog inputs according to previously stored instruction and to provide the results of these instructions as digital or analog outputs.

Metal: As used in this disclosure, a metal is an element that readily loses electrons or an alloy formed from a plurality of such elements. General properties of metals include, but are not limited to, the ability to conduct electricity, malleability, and the ability to be drawn into a wire. For the purposes of this disclosure, the term metal is assumed to include the transition metals (columns 3-12 of the periodic table) and aluminum, tin, and lead. The alkali metals (columns 1 of the periodic table) and the alkali earth metals (column 2 of the periodic table) are assumed to be excluded from this definition. In this disclosure, the preferred metals of choice are copper, aluminum, silver, and gold.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Sheeting: As used in this disclosure, sheeting is a material, such as cloth or plastic, in the form of a thin flexible layer or layers.

Textile: As used in hit, disclosure, a textile is a material that is woven, knitted, braided or felted. Synonyms in common usage for this definition include fabric and cloth.

Transistor: As used in this disclosure, a transistor is a general term for a three terminal semiconducting electrical that is used for electrical signal amplification and electrical switching applications. There are several designs of transistors. A common example of a transistor is an NPN transistor that further comprises a collector terminal, an emitter terminal, and a base terminal and which further consists of a combination of two rectifying junctions (a diode is an example of a rectifying junction). Current flowing from the collector terminal through the emitter terminal crosses the two rectifier junctions. The current allowed across the two rectified junctions is controlled by current that flows through the base terminal USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

Vcc: As used in this disclosure, Vcc is an acronym for Voltage at the Common Collector. Technically, the Vcc is the primary power source for an NPN transistor. In this disclosure, the definition of Vcc is more broadly defined to mean a direct current voltage source.

Warp: As used in this disclosure, the warp is the set of lengthwise yarns that are held in tension on a frame or loom. Each individual warp thread in a fabric is called a warp end.

Weft: As used in this disclosure, the weft is the yarn or yarns that are inserted over and under the warp yarns. In common usage, the weft may also be referred to as the filling yarn or filler.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A lighting device comprising:

a plurality of yarns, a plurality of wires, a plurality of LEDs, a plurality of control circuits, and a logic module;

wherein the lighting device is a textile;

wherein the textile is selected from the group consisting of a textile and a composite textile;

wherein the textile incorporates the plurality of wires and the plurality of LEDs in such a manner that the textile is illuminated;

wherein the textile incorporates the plurality of wires, the plurality of LEDs, the plurality of control circuits, and the logic module in such a manner that the illumination of the textile is controlled in a programmable manner;

wherein the plurality of wires are connected to the plurality of LEDs;

wherein the plurality of control circuits illuminate the plurality of LEDs;

wherein the plurality of control circuits are controlled with the logic module;

wherein the plurality of control circuits control the voltages on each of the plurality of wires;

wherein the logic module controls a level of the voltage generated by the plurality of control circuits;

wherein each LED selected from the plurality of LEDs is further defined with an anode and a cathode;

wherein the plurality of yarns further comprises a sub-plurality of warp yarns and a sub-plurality of weft yarns;

wherein each of the plurality of wires is incorporated into the textile such that each of the plurality of wires is parallel to the sub-plurality of warp yarns;

wherein each of the plurality of wires is incorporated into the textile using a method selected from the group consisting of weaving or knitting.

2. The lighting device according to claim 1 wherein the plurality of wires further comprises a plurality of lines;

wherein there is a one to one correspondence between each of the plurality of wires and each of the plurality of lines;

wherein each of the plurality of wires is a line;

wherein the plurality of lines contains greater than 3 lines;

wherein the anode of each individual LED selected from the plurality of LEDs is attached to a first line selected from the plurality of LEDs;

wherein the cathode of each individual LED selected from the plurality of LEDs is attached to a second line, different from the first line, selected from the plurality of LEDs.

3. The lighting device according to claim 2 wherein for any first line selected from the plurality of lines and any second line selected from the plurality of lines at least one first LED selected from the plurality of LEDs exists such that the anode of the first LED is electrically connected to the first line and the cathode of the first LED is electrically connected to the second line;

wherein for any first line selected from the plurality of lines and any second line selected from the plurality of lines at least one second LED selected from the plurality of LEDs exists such that the anode of the second LED is electrically connected to the second line and the cathode of the second LED is electrically connected to first second line.

4. The lighting device according to claim 3 wherein each line selected from the plurality of lines is electrically connected to one and only one control circuit selected from the plurality of control circuits;

wherein each control circuit selected from the plurality of control circuits is electrically connected to one or more lines selected from the plurality of lines.

5. The lighting device according to claim 4 wherein each control circuit selected from the plurality of control circuits generates an electrical voltage;

wherein each control circuit selected from the plurality of control circuits applies the generated electrical voltage to the one or more lines selected from the plurality of lines to which the control circuit is electrically connected.

6. The lighting device according to claim 5 wherein the logic module is a programmable device;

wherein the logic module is electrically connected to each control circuit selected from the plurality of control circuits;

wherein the logic module generates an individual primary line signal for each control circuit electrically connected to the logic module;

wherein a first individual primary line signal generated for a first control circuit selected from the plurality of control circuits is generated independently of any second individual primary line signal generated for a second control circuit selected from the plurality of control circuits.

7. The lighting device according to claim 6 wherein the primary line signal triggers the individual control circuit associated with the primary line signal to generate and apply a first voltage to the line associated with the individual control circuit.

8. The lighting device according to claim 7 wherein the each individual control circuit selected from the plurality of control circuits is identical to the individual control circuits remaining in the plurality of control circuits;

wherein each individual control circuit selected from the plurality of control circuits comprises a first transistor, a second transistor, a first resistor, a second resistor, a third resistor, and a Vcc;

wherein the Vcc is electrically connected to the first resistor;

wherein the Vcc is electrically connected to the third resistor;

wherein the third resistor is electrically connected to the collector of the first transistor;

wherein the third resistor is electrically connected to the base of the second transistor;

wherein the primary line signal is electrically connected to the base of the first transistor;

wherein the emitter of the first transistor is electrically connected to the circuit ground;

wherein the first resistor is electrically connected to the collector of the second transistor;

wherein the first resistor is electrically connected to the collector of the second resistor;

wherein the first resistor is electrically connected to the line selected from the plurality of lines that is associated with the individual control circuit selected from the plurality of control circuits;

wherein the emitter of the second transistor is electrically connected to the circuit ground;

wherein the second resistor is electrically connected to the circuit ground.

9. The lighting device according to claim 7 wherein the logic module further generates a secondary line signal for each control circuit electrically connected to the logic module;

wherein a secondary individual primary line signal generated for a first control circuit selected from the plurality of control circuits is generated independently of any second individual secondary line signal generated for a second control circuit selected from the plurality of control circuits;

wherein the secondary line signal triggers the individual control circuit associated with the secondary line signal to generate and apply a second voltage to the line associated with the individual control circuit;

wherein when the secondary line signal is generated simultaneously with the primary line signal, the secondary line signal triggers the individual control circuit associated with the secondary line signal to generate and apply a second voltage to the line associated with the individual control circuit;

wherein the voltage of the second voltage is different from the voltage of the first voltage.

10. The lighting device according to claim 9 wherein the each individual control circuit selected from the plurality of control circuits is identical to the individual control circuits remaining in the plurality of control circuits;

wherein each individual control circuit selected from the plurality of control circuits comprises a first operational amplifier, a second operational amplifier, a fourth resistor, a fifth resistor, and a sixth resistor;

wherein the fourth resistor, the fifth resistor, the sixth resistor, and the first operational amplifier are arranged in a voltage adder circuit;

wherein the primary line signal is an input into the voltage adder circuit;

wherein the secondary line signal is an input into the voltage adder circuit;

wherein second operational amplifier is configured as an inverter;

wherein the output of the inverter is electrically connected to the line selected from the plurality of lines that is associated with the individual control circuit selected from the plurality of control circuits.

11. The lighting device according to claim 1 wherein the plurality of wires are subdivided into a plurality of sub-plurality of wires;

wherein each sub-plurality of wires selected from the plurality of sub-plurality of wires is formed into a mesh;

wherein the lighting device further comprises a plurality of wire meshes that further comprises the collection of individual wire meshes formed from each sub-plurality of wires selected from the plurality of sub-plurality of wires;

wherein each individual wire mesh is a net like structure;

wherein each wire contained within each individual wire mesh is electrically connected to the each of the wires remaining in the individual wire mesh;

wherein the textile is formed as a composite textile that comprises a plurality of layers;

wherein each individual wire mesh is interspersed between individual layers of the composite textile;

wherein each wire mesh selected from the plurality of wire meshes is isolated from the wire meshes remaining in the plurality of wire meshes by at least one layer selected from the plurality of layers.

12. The lighting device according to claim 11 wherein the plurality of wire meshes further comprises a plurality of lines;

wherein there is a one to one correspondence between each of the plurality of wire meshes and each of the plurality of lines;

wherein each of the plurality of wire meshes is a line;

wherein the plurality of lines contains greater than 3 lines;

wherein the anode of each individual LED selected from the plurality of LEDs is attached to a first line selected from the plurality of LEDs;

wherein the cathode of each individual LED selected from the plurality of LEDs is attached to a second line, different from the first line, selected from the plurality of LEDs;

wherein for any first line selected from the plurality of lines and any second line selected from the plurality of lines at least one first LED selected from the plurality of LEDs exists such that the anode of the first LED is electrically connected to the first line and the cathode of the first LED is electrically connected to the second line;

wherein for any first line selected from the plurality of lines and any second line selected from the plurality of lines at least one second LED selected from the plurality of LEDs exists such that the anode of the second LED is electrically connected to the second line and the cathode of the second LED is electrically connected to first second line.

13. The lighting device according to claim 12 wherein each line selected from the plurality of lines is electrically connected to one and only one control circuit selected from the plurality of control circuits;

wherein each control circuit selected from the plurality of control circuits is electrically connected to one or more lines selected from the plurality of lines.

14. The lighting device according to claim 13 wherein each control circuit selected from the plurality of control circuits generates an electrical voltage;

wherein each control circuit selected from the plurality of control circuits applies the generated electrical voltage to the one or more lines selected from the plurality of lines to which the control circuit is electrically connected.

15. The lighting device according to claim 14 wherein the logic module is a programmable device;

wherein the logic module is electrically connected to each control circuit selected from the plurality of control circuits;

wherein the logic module generates an individual primary line signal for each control circuit electrically connected to the logic module;

wherein a first individual primary line signal generated for a first control circuit selected from the plurality of control circuits is generated independently of any second individual primary line signal generated for a second control circuit selected from the plurality of control circuits.

16. The lighting device according to claim 15 wherein the primary line signal triggers the individual control circuit associated with the primary line signal to generate and apply a first voltage to the line associated with the individual control circuit.

17. The lighting device according to claim 16 wherein the each individual control circuit selected from the plurality of control circuits is identical to the individual control circuits remaining in the plurality of control circuits;

wherein each individual control circuit selected from the plurality of control circuits comprises a first transistor, a second transistor, a first resistor, a second resistor, a third resistor, and a Vcc;

wherein the Vcc is electrically connected to the first resistor;

wherein the Vcc is electrically connected to the third resistor;

wherein the third resistor is electrically connected to the collector of the first transistor;

wherein the third resistor is electrically connected to the base of the second transistor;

wherein the primary line signal is electrically connected to the base of the first transistor;

wherein the emitter of the first transistor is electrically connected to the circuit ground;

wherein the first resistor is electrically connected to the collector of the second transistor;

wherein the first resistor is electrically connected to the collector of the second resistor;

wherein the first resistor is electrically connected to the line selected from the plurality of lines that is associated with the individual control circuit selected from the plurality of control circuits;

wherein the emitter of the second transistor is electrically connected to the circuit ground;

wherein the second resistor is electrically connected to the circuit ground.

18. The lighting device according to claim 16 wherein the logic module generates a secondary line signal for each control circuit electrically connected to the logic module;

wherein a secondary individual primary line signal generated for a first control circuit selected from the plurality of control circuits is generated independently of any second individual secondary line signal generated for a second control circuit selected from the plurality of control circuits;

wherein the secondary line signal triggers the individual control circuit associated with the secondary line signal to generate and apply a second voltage to the line associated with the individual control circuit;

wherein when the secondary line signal is generated simultaneously with the primary line signal, the secondary line signal triggers the individual control circuit associated with the secondary line signal to generate and apply a second voltage to the line associated with the individual control circuit;

wherein the voltage of the second voltage is different from the voltage of the first voltage.

19. The lighting device according to claim 18 wherein the each individual control circuit selected from the plurality of control circuits is identical to the individual control circuits remaining in the plurality of control circuits;

wherein each individual control circuit selected from the plurality of control circuits comprises a first operational amplifier, a second operational amplifier, a fourth resistor, a fifth resistor, and a sixth resistor;

wherein the fourth resistor, the fifth resistor, the sixth resistor, and the first operational amplifier are arranged in a voltage adder circuit;

wherein the primary line signal is an input into the voltage adder circuit;

wherein the secondary line signal is an input into the voltage adder circuit;

wherein second operational amplifier is configured as an inverter;

wherein the output of the inverter is electrically connected to the line selected from the plurality of lines that is associated with the individual control circuit selected from the plurality of control circuits.

* * * * *